US005606300A

United States Patent [19]

Koyama et al.

[11] Patent Number: 5,606,300

[45] Date of Patent: Feb. 25, 1997

[54] SUPERCONDUCTING MAGNET SUPERCONDUCTING MAGNET COIL, AND MANUFACTURING METHOD THEREOF

[75] Inventors: Toru Koyama, Hitachi; Masao Suzuki, Katsuta; Yasuhiro Mizuno, Hitachi; Koo Honjo, Ibaraki; Morimichi Umino, Hitachioota; Shigeo Amagi, Ibaraki; Shunichi Numata, Hitachi, all of Japan

[73] Assignee: Hitachi, Ltd., Tokyo, Japan

[21] Appl. No.: 594,444

[22] Filed: Jan. 31, 1996

Related U.S. Application Data

[63] Continuation of Ser. No. 165,920, Dec. 14, 1993, abandoned.

[30] Foreign Application Priority Data

Dec. 18, 1992 [JP] Japan ..... 4-338352

[51] Int. Cl.$^6$ ..... H01F 1/00; H01F 36/00; H01F 6/00; H01B 12/00

[52] U.S. Cl. ..... 335/216; 336/DIG. 1; 323/360; 505/211; 505/879

[58] Field of Search ..... 335/216; 336/DIG. 1; 323/360; 505/211, 230, 880, 870, 879

[56] References Cited

U.S. PATENT DOCUMENTS 5,189,386 2/1993 Tada ..... 335/216

FOREIGN PATENT DOCUMENTS 0488275 6/1992 European Pat. Off. .
2672538 2/1992 France .

OTHER PUBLICATIONS

Patent Abstracts of Japan, vol. 13(110), Mar. 16, 1989.
Patent Abstracts of Japan, vol. 13(352), Aug. 8, 1989.
Van de Voorde, M, "Results of physical tests on polymers at Cryogenic temperatures," cryogenics, 16(5), 296–302, 1976.
Steger, V. Y., "Evaluation of two polyurethane resins for injection shimming of the MFTF magnet," Report UCRL–15175, CASD–222–79–004, 1980.

*Primary Examiner*—Leo P. Picard
*Assistant Examiner*—Stephen T. Ryan
*Attorney, Agent, or Firm*—Antonelli, Terry, Stout & Kraus, LLP

[57] ABSTRACT

A superconducting magnet coil, an insulating layer, and a superconducting magnet which do not generate quenching under cooled and operational conditions are provided by using a fixing resin capable of suppressing microcrack generation in a resin layer which causes quenching.

A superconducting magnet coil manufactured by winding a superconducting wire and fixing the wire with resin and a method for manufacturing thereof, wherein said resin is a low cooling restricted thermal stress and high toughness fixing resin having a release rate of elastic energy $G_{IC}$ at 4.2 K. of at least 250 $J \cdot m^{-2}$, and/or a stress intensity factor $K_{IC}$ of at least 1.5 $MPa \cdot \sqrt{m}$, and/or a stress safety factor at 4.2 K. of at least 3, and an allowable defect size at least of 0.3 mm.

The superconducting magnet coil manufactured in accordance with the present invention does not cause quenching because microcracks are not generated in said resin when the coil is cooled to the liquid helium temperature, i.e. 4.2 K., and under an operational condition.

21 Claims, 4 Drawing Sheets

SUPERCONDUCTING MAGNET SUPERCONDUCTING MAGNET COIL, AND MANUFACTURING METHOD THEREOF

This application is a Continuation application of application Ser. No. 165,920, filed Dec. 14, 1993 now abandoned.

BACKGROUND OF THE INVENTION (1) Field of the Invention

The present invention relates to a superconducting magnet, a superconducting magnet coil, a permanent electric current switch, magnetic resonance imaging apparatus, and manufacturing methods thereof.

(2) Description of the Prior Art

A superconducting magnet using a superconducting coil can flow large electric current without any electric power loss because its electric resistance becomes substantially zero when cooled to liquid helium temperature, and consequently, it has merits to make an apparatus using the superconducting magnet reduce its size smaller and increase its magnetic field higher in comparison with an apparatus using a normal conducting magnet. Therefore, application of the superconducting magnet to MRI (magnetic resonance imaging apparatus), magnetic levitating vehicles, superconducting electromagnetic propulsion ships, nuclear fusion reactor, superconducting generators, K meson irradiation curative apparatus, accelerators, electron microscopes, and energy storing apparatus are under development. And, permanent electric current switches using superconducting coils are being developed because electricity is confined in the superconducting coils. Such a superconducting coil as explained above which is used in a condition being immersed in liquid helium sometime transfers from a superconducting condition to an normal conducting condition, so-called quenching phenomenon is caused, when temperature of superconducting material of the coil increases by friction heat and so on when the superconducting material moves by electromagnetic force and/or mechanical force. Therefore, intervals of wires in the superconducting coil are sometimes adhered with an impregnating resin such as epoxy resin, and the like.

Thermal shrinkage factor of the impregnating resin such as epoxy resin and the like when they are cooled down from a glass transition temperature to a liquid helium temperature, i.e. 4.2 K., is 1.8–3.0%. while, that of the superconducting wire is about 0.3–0.4%. As Y. IWASA pointed out in a reference, "Cryogenics" vol. 25, p304–p326 (1985), when a superconducting magnet coil is cooled down to a liquid helium temperature, i.e. 4.2 K., a cooling restricted thermal stress occurs on account of mismatch in thermal shrinkage factors of the impregnating resin and the superconducting wire.

At a liquid helium temperature, that is extremely low temperature such as 4.2 K., the impregnating resin such as epoxy resin, and the like, becomes very hard and brittle. The above cooling restricted thermal stress and stresses caused by electromagnetic forces in operating conditions concentrate to defects such as voids and cracks generated by manufacturing in the impregnating resin. Microcracks of a few micrometers are generated in the impregnating resin, temperature of portions in the vicinity of the microcracks rises a few degrees on account of stress release energy of the microcrack generation, when the above stresses are larger than its strength and toughness. When the impregnant-crack-induced temperature rise is larger than cooling power, electric resistance of the superconducting wire increases rapidly, and hence, the problem causing transfer of the superconducting condition to the normal conducting condition, so-called quenching phenomenon, is generated.

JP-A-61-48905 (1986) discloses a method for preventing heat generation and quenching caused by electromagnetic vibration of wires by applying phenoxy resin onto superconducting wire having polyvinyl formal insulation, winding, and adhering the wires each other. However, there are problems that the phenoxy resin are solid, and must be dissolved in solvent, and the superconducting wire causes quenching because the applying and winding the wires necessarily generate voids between the wires and the voids become starting points of crack and heat generation.

SUMMARY OF THE INVENTION (1) Objects of the Invention

The present invention is achieved in view of solving the above problems, and an object of the present invention is to provide superconducting magnets, superconducting magnet coils, permanent electric current switches, and magnetic resonance imaging apparatus, in which microcracks in an impregnating resin are scarcely generated and quenching in an operating condition does not occur.

(2) Methods of Solving the Problems

The object of the present invention can be achieved by using a resin of low cooling restricted thermal stress and high toughness having at least 3 for a stress safety factor which is defined as a ratio of strength/cooling restricted thermal stress and/or at least 0.3 mm for an equivalent allowable size of defect as for the impregnating resin of the superconducting magnet coils when the resin is cooled down from a glass transition temperature to a liquid helium temperature, i.e. 4.2 K.

Stresses loaded on a superconducting magnet coil in an operating condition are such as a residual stress at manufacturing, a cooling restricted thermal stress, and an electromagnetic force at the operating condition. First, a cooling restricted thermal stress on an impregnating resin of the superconducting magnet coil generated when the coil is cooled to a liquid helium temperature, i.e. 4.2 K., after its fabrication is explained hereinafter.

The cooling restricted thermal stress, $\sigma_R$, on the impregnating resin of the superconducting magnet coil generated when the coil is cooled to a liquid helium temperature, i.e. 4.2 K., after its fabrication can be expressed by the following equation (1).

$$\sigma_R = \int_{T}^{4.2\,\mathrm{K}} (\alpha_R - \alpha_S) E \, dT \tag{1}$$

where, $\alpha_R$ is a thermal expansion coefficient of the impregnating resin, $\alpha_S$ is a thermal expansion coefficient of the superconducting wire, E is an elastic modulus of the impregnating resin, T is temperature of the impregnating resin in the superconducting magnet coil. The elastic modulus at higher temperature than glass transition temperature Tg is smaller approximately by two orders than that at lower temperature than the glass transition temperature Tg, and accordingly, the cooling restricted thermal stress, $\sigma_R$, on the impregnating resin of the superconducting magnet coil generated when the coil is cooled to a liquid helium temperature, i.e. 4.2 K., after its fabrication can be expressed substantially by the following equation (2).

$$\sigma_R = \int_{Tg}^{4.2\,K} (\alpha_R - \alpha_S)E\,dT \quad (2)$$

The equivalent allowable size of defect, $\alpha_e$ of the superconducting magnet coil when the coil is cooled to a liquid helium temperature, i.e. 4.2 K., after its fabrication can be expressed approximately by the following equation (3).

$$a_e=(K_{IC}/\sigma_R)^2/1.258\pi \quad (3)$$

where, $K_{IC}$ is a stress intensity factor, $\sigma_R$ is the cooling restricted thermal stress calculated by the above equation (2).

Usually, a relationship between the $K_{IC}$ and a release rate of elastic energy $G_{IC}$ can be expressed by the following equation (4).

$$G_{IC}=(K_{IC})^2/E \quad (4)$$

where, E is an elastic modulus of the impregnating resin.

Bending strength $\sigma_B$, the release rate of elastic energy $G_{IC}$, and stress intensity factor $K_{IC}$ of the actual impregnating resin at 4.2 K. were observed by varying thermal shrinkage and elastic modulus of the impregnating resin, stress safety factor defined as strength/cooling restricted thermal stress, i.e. $\sigma_B/\sigma_R$, were obtained by calculating the cooling restricted thermal stress $\sigma_R$ and the equivalent allowable size of defect $a_e$ using the above equations from the above observed values, and examined the relationship among the stress safety factor, the equivalent allowable size of defect, and quenching of the superconducting magnet coil. As a result, it was revealed that using a resin of low cooling restricted thermal stress and high toughness having at least 4, preferably at least 5 for the stress safety factor when the resin was cooled down from a glass transition temperature to a liquid helium temperature, i.e. 4.2 K., and/or at least 0.3 mm, preferably at least 0.5 mm for the equivalent allowable size of defect as for the impregnating resin of the superconducting magnet coil prevented the impregnating resin from generating microcracks and causing quenching when the superconducting magnet coil was cooled down to a liquid helium temperature, i.e. 4.2 K., after its fabrication, or in an operation condition.

The present invention can be summarized as follows;

The first feature of the present invention is on a fabrication method for superconducting magnet coil comprising steps of winding and impregnating superconducting wires with an impregnating resin characterized in that the resin of low cooling restricted thermal stress and high toughness having at least 3, preferably at least 4 for the stress safety factor when the resin was cooled down to a liquid helium temperature, i.e. 4.2 K., and/or at least 0.3 mm, preferably at least 0.5 mm for the equivalent allowable size of defect is used as for the impregnating resin.

The second feature of the present invention is on a superconducting magnet coil being fabricated by winding and impregnating the superconducting wire with an impregnating resin characterized in that the resin of low cooling restricted thermal stress and high toughness having at least 3, preferably at least 4 for the stress safety factor when the resin was cooled down from a glass transition temperature to a liquid helium temperature, i.e. 4.2 K., and/or at least 0.3 mm, preferably at least 0.5 mm for the equivalent allowable size of defect is used as for the impregnating resin.

The third feature of the present invention is on a superconducting magnet characterized in using the superconducting magnet coil fabricated with an impregnating resin of low cooling restricted thermal stress and high toughness having at least 3, preferably at least 4 for the stress safety factor when the resin was cooled down from a glass transition temperature to a liquid helium temperature, i.e. 4.2 K., and/or at least 0.3 mm, preferably at least 0.5 mm for the equivalent allowable size of defect.

The superconductive wires are covered with a coating or a film of at least one member selected from the group consisting of polyvinyl formal, polyvinyl butyral, polyester, polyurethane, polyamide, polyamide-imide and polyimides.

As for the impregnating resin for the superconducting magnet coil in the present invention, there is no restriction on kind of resin if the resin is of low cooling restricted thermal stress and high toughness having at least 3, preferably at least 5 for the stress safety factor when the resin was cooled down from a glass transition temperature to a liquid helium temperature, i.e. 4.2 K., and/or at least 0.3 mm, preferably at least 0.5 mm for the equivalent allowable size of defect so far. In the above case, the stress safety factor in a range 3–11 when the resin was cooled down from a glass transition temperature to a liquid helium temperature, i.e. 4.2 K., and the equivalent allowable size of defect in a range 0.3–20 mm were desirable, particularly, the stress safety factor in a range 4–11 and the equivalent allowable size of defect in a range 0.5–20 mm were preferable.

As for the impregnating resin having the above described preferable characteristics, thermoplastic resin or thermosetting resin of types which can be molten by heating without solvent and casted or immersed to coils so as to avoid generation of voids are used. As for examples, there are such thermoplastic resins as polycarbonates, high density polyethylene, polyallylates, polyvinyl chloride, ethylene vinylacetate, polyamides, polycaprolactams, polycaprolactones, polyurethane rubber, fluorine resins, polypropylene, polymethylpentene, polyurethanes, aromatic olefine polymers, aromatic olefine copolymers, polyphenylene sulfides, polyphenylene oxides, polysulfones, polyether ethersulfones, polybutyl vinylal, copolymers of olefine and stylene, and the like, and such thermosetting resins as polyoxazolidone resins, acid anhydride cured epoxy resins, amine cured epoxy resins, maleimide resin, unsaturated polyester resin, polyurethane resin, and the like. Of these resins, the resins having at least 250 $J\cdot m^{-2}$ and especially 250–10,000 $J\cdot m^{-2}$ for a release rate of elastic energy $G_{IC}$ at 4.2 K., and/or at least 1.3 $MPa.\sqrt{m}$ for a stress intensity factor $K_{IC}$ are desirable. Particularly, the resins having the release rate of elastic energy $G_{IC}$ at 4.2 K. in a range from 300 to 10000 $J\cdot m^{-2}$, and the stress intensity factor $K_{IC}$ in a range from 1.5 to 8 $MPa.\sqrt{m}$ are preferable.

Thermoplastic resins having high toughness at 4.2 K. such as polycarbonates, polyallylates, polyphenylene sulfides, polyphenylene oxides, and the like, are especially preferable as the impregnating resin for permanent current switches and superconducting magnet coils.

And, a resin composition comprising polyfunctional isocyanates and polyfunctional epoxy resins has high toughness at 4.2 K., large strength, and low cooling restricted thermal stress, and are especially preferable as the impregnating resin for permanent current switches and superconducting magnet coils. The resin composition comprising polyfunctional isocyanates and polyfunctional epoxy resins causes by heating linear polyoxazolidone ring bonds formation, isocyanurates ring bonds formation to form a three dimensional net work structure, and ring-opening polymerization of epoxy to form a three dimensional net work structure, and is cured. In view of low cooling restricted thermal stress and high toughness, it is preferable to make the cured resin contain mainly the linear oxazolidone ring bonds. That means, it is desirable to mix 0.1–5.0 equivalent polyfunctional isocyanates to 1 equivalent polyfunctional epoxy resin in order not to form the isocyanurates ring bonds forming a three dimensional net work structure. Particularly, it is preferable to mix 0.25–0.9 equivalent polyfunctional isocyanates to 1 equivalent polyfunctional epoxy resin.

The polyfunctional isocyanate usable in the present invention can be any isocyanate if it contains at least two isocyanate groups. Examples of such compounds usable in the present invention are methane diisocyanate, buthane-1,1-diisocyanate, ethane-1,2-diisocyanate, buthane-1,2-diisocyanate, transvinylene diisocyanate, propane-1,3-diisocyanate, buthane-1,4-diisocyanate, 2-buthene-1,4-diisocyanate, 2-methylbuthane-1,4-diisocyanate, pentane-1,5-diisocyanate, 2,2-dimethylpentane-1,5-diisocyanate, hexane-1,6-diisocyanate, heptane-1,7-diisocyanate, octane-1,8-diisocyanate, nonane-1,9-diisocyanate, decane-1,10-diisocyanate, dimethylsilane diisocyanate, diphenylsilane diisocyanate, ω,ω'-1,3-dimethylbenzene diisocyanate, ω,ω'-1,4-dimethylbenzene diisocyanate, ω,ω'-1,3-dimethylcyclohexane diisocyanate, ω,ω'-1,4-dimethylcyclohexane diisocyanate, ω,ω'-1,4-dimethylnaphthalene diisocyanate, ω,ω'-1,5-dimethylnaphthalene diisocyanate, cyclohexane-1,3-diisocyanate, cyclohexane-1,4-diisocyanate, dicyclohexylmethane-4,4'-diisocyanate, 1,3-phenylene diisocyanate, 1,4-phenylene diisocyanate, 1-methylbenezene-2,4-diisocyanate, 1-methylbenzene-2,5-diisocyanate, 1-methylbenzene-2,6-diisocyanate, 1 -methylbenzene-3,5-diisocyanate, diphenylether-4,4'-diisocyanate, diphenylether-2,4'-diisocyanate, naphthalene-1,4-diisocyanate, naphthalene-1,5-diisocyanate, biphenyl-4,4'-diisocyanate, 3,3'-dimethylbiphenyl-4,4'-diisocyanate, 2,3'-dimethoxybiphenyl-4,4'-diisocyanate, diphenylmethane-4,4'-diisocyanate, 3,3'-dimethoxydiphenylmethane-4,4'-diisocyanate, 4,4'-dimethoxydiphenylmethane-3,3'-diisocyanate, diphenylsulfide-4,4'-diisocyanate, diphenylsulfone-4,4'-diisocyanate, bifunctional isocyanates obtained by a reaction with tetramethylene diol and the above described bifunctional isocyanates, polymethylene polyphenyl isocyanate, triphenylmethane triisocyanate, tris(4-phenyl isocyanate thiophosphate), 3,3',4,4'-diphenylmethane tetraisocyanate, three or more isocyanates obtained by a reaction with trimethylol propane and the above described bifunctional isocyanates. Further, dimers and trimers of the above described isocyanates, liquid isocyanates obtained by partial conversion of diphenylmethane-4,4'-diisocyanate to carbodiimide, and the like, can be used. Of these compounds, the liquid isocyanate obtained by partial conversion of diphenylmethane-4,4'-diisocyanate to carbodiimide, and hexane-1,6-diisocyanate are preferable.

The polyfunctional epoxy resin usable in the present invention can be any epoxy resin if it contains at least two epoxy groups. Examples of such polyfunctional epoxy resin usable in the present invention are diglycidyl ether of bisphenol A, diglycidyl ether of bisphenol F, diglycidyl ether of bisphenol AF, diglycidyl ether of bisphenol AD, diglycidyl ether of bisphenol, diglycidyl ether of dihydroxynaphthalene, diglycidyl ether of hydrogenated bisphenol A, diglycidyl ether of 2,2'-(4-hydroxyphenyl)nonadecane, 4,4'-bis(2,3-epoxypropyl)diphenyl ether, 3,4-epoxycyclohexylmethyl-(3,4-epoxy)cyclohexane carboxylate, 4-(1,2-epoxypropyl)-1,2-epoxycyclohexane, 2-(3,4-epoxy)cyclohexyl-5,5-spiro(3,4-epoxy)-cyclohexane-m-dioxane, 3,4-epoxy-6-methylcyclohexylmethyl-4-epoxy-6-methylcyclohaxanecarboxylate, butadien modified epoxy resin, urethane modified epoxy resin, thiol modified epoxy resin, diglycidyl ether of diethylene glycol, diglycidyl ether of triethylene glycol, diglycidyl ether of polyethylene glycol, diglycidyl ether of polypropylene glycol, diglycidyl ether of 1,4-butane diol, diglycidyl ether of neopentyl glycol, bifunctional epoxy resins such as diglycidyl ether of an additive of bisphenol A and propylene oxide and diglycidyl ether of an additive of bisphenol A and ethylene oxide, and trifunctional epoxy resins such as tris[p-(2,3-epoxypropoxy)phenyl]methane and 1,1,3,-tris[p-(2,3-epoxypropoxy)phenyl]butane. Further, there are glycidyl amines such as tetraglycidyl diaminodiphenylmethane, triglycidyl-p-amonophenol, triglycidyl-m-aminophenol, diglycidylamine, tetraglycidyl-m-xylene diamine, tetraglycidyl bisaminomethylcyclohexane, and the like, and polyfunctional epoxy resins such as phenol novolak type epoxy resins, and cresol type epoxy resins. Polyfunctional epoxy resins obtained by a reaction of a mixture which contains at least two kinds of polyhydric phenols such as (a) Bis(4-hydroxyphenyl) methane, (b) Bis(4-hydroxyphenyl) ethane, (c) Bis(4-hydroxyphenyl) propane, (d) Tris(4-hydroxyphenyl) alkanes, (e) Tetrakis(4-hydroxyphenyl) alkanes, with epichlorohydrine can be used because the resins have low viscosity before curing and preferable usableness.

As for the tris(4-hydroxyphenyl) alkanes, there are such compounds as tris(4-hydroxyphenyl) methane, tris(4-hydroxyphenyl) ethane, tris(4-hydroxyphenyl) propane, tris(4-hydroxyphenyl) buthane, tris(4-hydroxyphenyl) hexane, tris(4-hydroxyphenyl) heptane, tris(4-hydroxyphenyl) octane, tris(4-hydroxyphenyl) nonane. Also, tris(4-hydroxyphenyl) alkane derivatives such as tris(4-hydroxydimethylphenyl) mathane and the like are usable.

As for the tetrakis(4-hydroxyphenyl) alkanes, there are such compounds as tetrakis(4-hydroxyphenyl) methane, tetrakis(4-hydroxyphenyl) ethane, tetrakis(4-hydroxyphenyl) propane, tetrakis(4-hydroxyphenyl) buthane, tetrakis(4-hydroxyphenyl) hexane, tetrakis(4-hydroxyphenyl) heptane, tetrakis(4-hydroxyphenyl) octane, tetrakis(4-hydroxyphenyl) nonane. Also, tetrakis(4-hydroxyphenyl) alkane derivatives such as tetrakis(4-hydroxydimethylphenyl) mathane and the like are usable. Among the above described compounds, diglycidyl ether of bisphenol A, diglycidyl ether of bisphenol F, diglycidyl ether of bisphenol AF, diglycidyl ether of bisphenol AD, or polymers of diglycidyl ether of bisphenol A, diglycidyl ether of bisphenol F, diglycidyl ether of bisphenol AF, and diglycidyl ether of bisphenol AD, diglycidyl ether of biphenol, diglycidyl ether of dihydroxynaphthalene are preferable in view of low thermal shrinkage. At least two kinds of the above described multifunction epoxy resins can be used together simultaneously.

The above described polyfunctional isocyanates and polyfunctional epoxy resins can be used solely and as a mixture of at least two kinds compounds.

Depending on necessity to lower viscosity of the compounds or the mixture, monofunctional isocyanates such as phenyl isocyanate, butylglycidyl ether, stylene oxide, phenylglycidyl ether, allylglycidyl ether, and the like, and monofunctional epoxy resins can be added. However, an addition of such compounds must be restricted to a small amount because the addition of monofunctional compounds has effects to lower the viscosity but concurrently to increase thermal shrinkage.

As for catalysts to cure the mixture of the above polyfunctional compounds, catalysts for generating hetero ring to form oxazolidone ring are preferable. Examples of such catalysts are tertially amines such as trimethylamine, triethylamine, tetramethylbutanediamine, triethylenediamine, and the like, amines such as dimethylaminoethanol, dimethylaminopentanol, tris(dimethylaminomethyl)phenol, N-methylmorphorine, and the like, quaternary ammonium salts of cetyltrimethylammonium bromide, cetyltrimethylammonium chloride, cetyltrimethylammonium iodide, dodecyltrimethylammonium bromide, dodecyltrimethylammonium chloride, dodecyltrimethylammonium iodide, benzyldimethyltetradecylammonium chloride, benzyldimethyltetradecylammonium bromide, allyldodecyltrimethylammonium bromide, benzyldimethylstearylammonium bromide, stearyltrimethylammonium chloride, benzyldimethyltetradecylammonium acetylate, and the like, imidazoles such as 2-methylimidazole, 2-ethylimidazole, 2-undecylimidazole, 2-heptadecylimidazole, 2-methyl-4-ethylimidazole, 1-butylimidazole, 1-propyl-2-methylimidazole, 1-benzyl-2-methylimidazole, 1-cyanoethyl-2-phenylimidazole, 1-cyanoethyl-2-methylimidazole, 1-cyanoethyl-2-undecylimidazole, 1-heptadecylimidazole, 2-methyl-4-ethylimidazole, 1-azine-2-metylimidazole, 1-azine-2-undecylimidazole, and the like, metallic salts of amines, microcoupleamines of imidazoles, and imidazoles, with zinc octanoate, cobalt, and the like, 1,8-diaza-bicyclo(5,4,0)-undecene-7, N-methyl-piperazine, tetramethylbutylguanidine, aminetetraphenyl borates such as triethylammoniumtetraphenyl borate, 2-ethyl-4-methyltetraphenyl borate, and 1,8-diaza-bicyclo(5,4,0)-undecene-7-tetraphenyl borate, triphenyl phosphine, triphenylphosphoniumtetraphenyl borate, aluminum trialkylacetoacetate, aluminum trisacetylacetoacetate, aluminum alcoholate, aluminum acylate, sodium alcoholate, metallic soaps of octylic acid and naphtenic acid with cobalt, manganese, iron, and the like, sodium cyanate, potassium cyanate, and the like. Of these compounds, particularly useful are quaternary ammonium salts, metallic salts of amines, and imidazoles, with zinc octanoate, cobalt, and the like, aminetetraphenyl borates, microcapsules of amines and imidazoles because they are relatively stable at a room temperature, but can cause a reaction easily at an elevated temperature, that is, they are particularly useful because of latent curing catalysts. These curing catalysts are added ordinarily in an amount of 0.1–10% by weight based on the polyfunctional epoxy resin and the polyfunctional isocyanate.

The superconducting magnet coil of the present invention can be fabricated by any one of the following methods:

(1) A method comprising the steps of (a) winding a superconducting wire in the shape of a coil, (b) impregnating into the coil an impregnating resin having a viscosity of 0.01–10 poise, a stress safety factor in the range of 3–11, or an equivalent allowable size of defect in the range of 0.3–20 mm when cooled from a glass transient temperature after hardening to a liquid helium temperature, i.e. 4.2 K., and (c) curing the impregnating resin.

(2) A method comprising the steps of winding the superconducting wire covered with an insulating resin to form a coil, and impregnating into the coil an impregnating resin having a stress safety factor in the range of 3–11 when the resin is cooled from a glass transition temperature of said resin to 4.2 K., and (c) curing the impregnating resin by the application of heat.

Further, the impregnating resin preferably has a viscosity of 0.01–10 poise in order to impregnate sufficiently into the spaces or intervals between the wound wires of the coil for avoiding generation of voids.

DETAILED DESCRIPTION OF THE EMBODIMENTS

Figure 1:
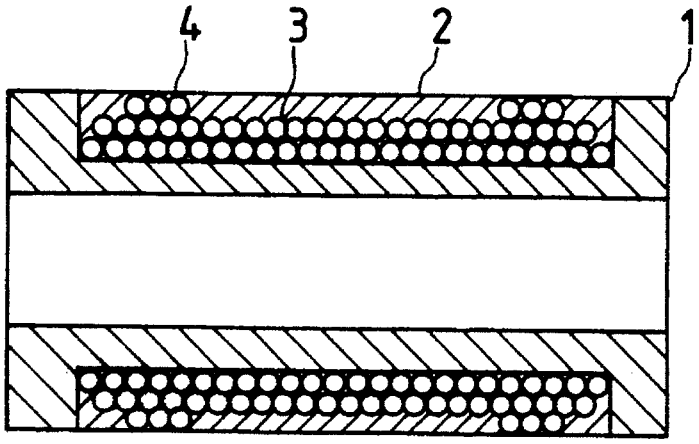
FIG. 1 is a schematic vertical cross section of a permanent current switch relating to the first embodiment of the present invention.

The present invention is hereinafter described more specifically referring to embodiments, but the present invention is by no means restricted by these embodiments.

Determination of thermal expansion coefficients, $\alpha_R$, $\alpha_S$, was performed with a thermal mechanical analyzer (TMA) having a sample system provided in a cryostat which could cool a sample to a very low temperature, and a measuring system containing a detecting rod which transferred the change of the sample dimension to a portion at a room temperature and a differential transformer with which the change of the sample dimension was determined. Modulus of elasticity, E, was obtained by measuring visco-elastic behavior from a liquid helium temperature. A cooling restricted thermal stress, $\sigma_R$, was calculated by substituting the equation (2) with the above described data. Bending strength, $\sigma_B$, was determined by immersing a sample in liquid helium using a conventional bending tester equipped with a cryostat which can cool the sample to a very low temperature. Size of the sample was 80×9×5 mm, and the condition of the determination was three point bending with a length between supports of 60 mm and a head speed of 2 mm/min. Fracture toughness test for determining a release rate of elastic energy, $G_{IC}$, was performed with a Double Cantilever Beam method in liquid helium.

The abbreviations for thermoplastic resina and thermosetting resins used in the embodiments are as follows;

Abbreviation: Materials

PC: polycarbonate

HDPE: high density polyethylene

PVC: polyvinyl chloride

PPO: polyphenylene oxide

PPS: polyphenylene sulfide

TPX: poly-4-methyl pentene

PP: polypropylene

PU: polyurethane

PCp: polycaprolactone

EVA: ethylenevinyl acetate

PAR: polyallylate

PVA: polyvinyl alcohol

PEEK: polyether ketone

PEI: polyether imide

POM: polyacetal

PO: polyphenylene oxide

PSF: polysulfone

PES: polyether sulfone

PPA: polyparabanic acid

PS: polystylene

PMMA: polymethylmethacrylate

SBS: stylene-butadien-stylene copolymer

SMA: stylene-maleic acid copolymer

DGEBA: diglycidylether of bisphenol A (epoxy equivalent 175)

DGEPN: diglycidylether of 1,6-naphthalene-diol (epoxy equivalent 142)

MDI: 4,4'-diphenylmethane diisocyanate (isocyanate equivalent 125)

L-MDI: MDI partially converted to carbodiimide which is liquid at a room temperature (isocyanate equivalent 140)

TDI: a mixture of 80% 2,4-tolylene diisocyanate and 20% 2,6-tolylene diisocyanate (isocyanate equivalent 87)

NDI: naphthylene diisocyanate (isocyanate equivalent 105)

HMDI: haxamethylene diisocyanate (isocyanate equivalent 84)

PPDI: p-phenylene diisocyanate (isocyanate equivalent 81)

DPEDI; 4,4'-diphenylether diisocyanate (isocyanate equivalent 126)

iPA-Na: sodium isopropolate

BTPP-K: tetraphenyl borate of triphenylbutylphosphine

2E4MZ-CN-K: tetraphenyl borate of 1-cyanoethyl-2-ethyl-4-methylimidazole

TPP-K: tetraphenyl borate of triphenylphosphine

TPP: triphenylphosphine

IOZ: a salt of 2-ethyl-4-methylimidazole and zinc octanoate

2E4MZ-CN: 1-cyanoethyl-2-ethyl-4-methylimidazole

BDMTDAC: benzyldimethyltetradecylammonium chloride

BDMTDAI: benzyldimethyltetradecylammonium iodide

LBO: lithium butoxide

OC: cobalt octanoate

Embodiments 1–59 and Comparative Examples 1,2

Each of compositions shown in Tables 1–13 was mixed, thoroughly stirred, placed in a mold, and heated. Thermal expansion coefficient $\alpha_R$ of the resulting cured resin was determined with a TMA from a glass transition temperature Tg to 4.2 K.

Modulus of elasticity, E, of the obtained resin was determined with a viscoelastic measuring apparatus from a glass transition temperature Tg to 4.2 K. A cooling restricted thermal stress, $\sigma_R$, was calculated by substituting the equation (1) with the above observed values. Bending strength, $\sigma_B$, was determined at 4.2 K., and a stress safety factor ($\sigma_B/\sigma_R$) was calculated. While, a release rate of elastic energy, $G_{IC}$, at 4.2 K. was determined by the Double Cantilever Beam method. Further, an equivalent allowable size of defect $\alpha_e$ was calculated using the equation (3). The bending strength, $\sigma_B$, the restrictive thermal stress, $\sigma_R$, the stress safety factor, the release rate of elastic energy, $G_{IC}$, and the equivalent allowable size of defect $\alpha_e$ obtained at 4.2 K. are shown together in Tables 1–13.

TABLE 1

| | Resin composition | | Bending strength at 4.2K (MPa) | Cooling restricted thermal stress (MPa) | Stress safety factor | Elastic release energy at 4.2K ($J \cdot m^{-2}$) | Fracture toughness at 4.2K ($MPa \cdot \sqrt{m}$) | Allowable defect size cooled at 4.2K (mm) |
|---|---|---|---|---|---|---|---|---|
| Embodiment 1 | PC | 100 | 280 | 32 | 8.8 | 8000 | 7.4 | 13.2 |
| Embodiment 2 | HDPE | 100 | 185 | 37 | 5.0 | 4600 | 5.7 | 5.9 |
| Embodiment 3 | PPO | 100 | 250 | 31 | 8.1 | 7500 | 7.2 | 13.6 |
| Embodiment 4 | PPS | 100 | 290 | 32 | 9.1 | 8200 | 7.6 | 13.9 |
| Embodiment 5 | TPX | 100 | 160 | 30 | 5.3 | 2500 | 4.2 | 4.9 |

TABLE 2

| | Resin composition | | Bending strength at 4.2K (MPa) | Cooling restricted thermal stress (MPa) | Stress safety factor | Elastic release energy at 4.2K ($J \cdot m^{-2}$) | Fracture toughness at 4.2K ($MPa \cdot \sqrt{m}$) | Allowable defect size cooled at 4.2K (mm) |
|---|---|---|---|---|---|---|---|---|
| Embodiment 6 | PP | 100 | 190 | 39 | 4.9 | 5000 | 5.9 | 5.8 |
| Embodiment 7 | PU | 100 | 200 | 38 | 5.3 | 5500 | 6.2 | 6.7 |
| Embodiment 8 | PCp | 100 | 210 | 36 | 5.83 | 5600 | 6.3 | 7.6 |
| Embodiment 9 | EVA | 100 | 250 | 35 | 7.1 | 6000 | 6.5 | 8.6 |
| Embodiment 10 | PAR | 100 | 300 | 28 | 10.7 | 8500 | 7.7 | 11.4 |

TABLE 3

| | Resin composition | | Bending strength at 4.2K (MPa) | Cooling restricted thermal stress (MPa) | Stress safety factor | Elastic release energy at 4.2K ($J \cdot m^{-2}$) | Fracture toughness at 4.2K ($MPa \cdot \sqrt{m}$) | Allowable defect size cooled at 4.2K (mm) |
|---|---|---|---|---|---|---|---|---|
| Embodiment 11 | PVA | 100 | 220 | 35 | 6.3 | 5000 | 5.9 | 7.1 |
| Embodiment 12 | PEEK | 100 | 240 | 35 | 6.9 | 5500 | 6.2 | 7.9 |
| Embodiment 13 | PEI | 100 | 230 | 36 | 6.4 | 5800 | 6.4 | 7.8 |
| Embodiment 14 | POM | 100 | 250 | 35 | 7.1 | 6300 | 6.6 | 9.0 |
| Embodiment 15 | PO | 100 | 180 | 35 | 5.1 | 6000 | 6.5 | 8.6 |

TABLE 4

| | Resin composition | | Bending strength at 4.2K (MPa) | Cooling restricted thermal stress (MPa) | Stress safety factor | Elastic release energy at 4.2K ($J \cdot m^{-2}$) | Fracture toughness at 4.2K ($MPa \cdot \sqrt{m}$) | Allowable defect size cooled at 4.2K (mm) |
|---|---|---|---|---|---|---|---|---|
| Embodiment 16 | PSF | 100 | 230 | 35 | 6.6 | 3000 | 4.6 | 4.3 |
| Embodiment 17 | PES | 100 | 220 | 38 | 5.8 | 6500 | 6.8 | 7.9 |
| Embodiment 18 | PPA | 100 | 235 | 35 | 6.7 | 7500 | 7.1 | 10.4 |
| Embodiment 19 | PPO | 95 | 280 | 32 | 8.7 | 7600 | 7.0 | 12.1 |
| | PO | 5 | | | | | | |
| Embodiment 20 | PAR | 95 | 300 | 28 | 10.7 | 8800 | 7.6 | 18.2 |
| | PO | 5 | | | | | | |

TABLE 5

| | Resin composition | | Bending strength at 4.2K (MPa) | Cooling restricted thermal stress (MPa) | Stress safety factor | Elastic release energy at 4.2K ($J \cdot m^{-2}$) | Fracture toughness at 4.2K ($MPa \cdot \sqrt{m}$) | Allowable defect size cooled at 4.2K (mm) |
|---|---|---|---|---|---|---|---|---|
| Embodiment 21 | PPS | 95 | 295 | 31 | 9.5 | 8300 | 7.4 | 14.0 |
| | PO | 5 | | | | | | |
| Embodiment 22 | PAR | 95 | 280 | 35 | 8.0 | 8600 | 7.8 | 12.2 |
| | PPO/SBS | 5 | | | | | | |
| Embodiment 23 | PC | 95 | 300 | 35 | 8.6 | 8500 | 7.7 | 12.1 |
| | PAR | 5 | | | | | | |
| Embodiment 24 | PC | 95 | 280 | 32 | 8.8 | 8200 | 7.6 | 14.0 |
| | HDPE | 5 | | | | | | |
| Embodiment 25 | PC | 95 | 280 | 35 | 8.0 | 8000 | 7.5 | 11.4 |
| | PO | 5 | | | | | | |

TABLE 6

| | Resin composition | | Bending strength at 4.2K (MPa) | Cooling restricted thermal stress (MPa) | Stress safety factor | Elastic release energy at 4.2K ($J \cdot m^{-2}$) | Fracture toughness at 4.2K ($MPa \cdot \sqrt{m}$) | Allowable defect size cooled at 4.2K (mm) |
|---|---|---|---|---|---|---|---|---|
| Comparative example 1 | PS | 100 | 80 | 37 | 2.2 | 138 | 0.98 | 0.2 |
| Comparative example 2 | PMMA | 100 | 120 | 36 | 3.3 | 130 | 0.95 | 0.2 |

TABLE 7

| | Resin composition | | Bending strength at 4.2K (MPa) | Cooling restricted thermal stress (MPa) | Stress safety factor | Elastic release energy at 4.2K ($J \cdot m^{-2}$) | Fracture toughness at 4.2K ($MPa \cdot \sqrt{m}$) | Allowable defect size cooled at 4.2K (mm) |
|---|---|---|---|---|---|---|---|---|
| Embodiment 26 | DGEBPA<br>L-MDI<br>2E4MZ-CN<br>(I/E = 0.25 Equivalent ratio) | 100<br>20<br>0.5 | 214 | 28 | 7.6 | 720 | 2.1 | 1.5 |
| Embodiment 27 | DGEBPA<br>L-MDI<br>2E4MZ-CN<br>(I/E = 0.50 Equivalent ratio) | 100<br>40<br>0.5 | 280 | 29 | 9.7 | 800 | 2.3 | 1.6 |
| Embodiment 28 | DGEBPA<br>L-MDI<br>2E4MZ-CN<br>(I/E = 0.75 Equivalent ratio) | 100<br>60<br>0.5 | 270 | 30 | 9.0 | 720 | 2.1 | 1.3 |
| Embodiment 29 | DGEBPA<br>L-MDI<br>2E4MZ-CN<br>(I/E = 1.0 Equivalent ratio) | 100<br>80<br>0.5 | 240 | 31 | 7.7 | 620 | 2.0 | 1.0 |
| Embodiment 30 | DGEBPA<br>L-MDI<br>2E4MZ-CN<br>(I/E = 1.25 Equivalent ratio) | 100<br>100<br>0.5 | 175 | 37 | 4.7 | 518 | 1.8 | 0.73 |

TABLE 8

| | Resin composition | | Bending strength at 4.2K (MPa) | Cooling restricted thermal stress (MPa) | Stress safety factor | Elastic release energy at 4.2K ($J \cdot m^{-2}$) | Fracture toughness at 4.2K ($MPa \cdot \sqrt{m}$) | Allowable defect size cooled at 4.2K (mm) |
|---|---|---|---|---|---|---|---|---|
| Embodiment 31 | DGEBPA<br>L-MDI<br>2E4MZ-CN<br>(1/E = 1.5 Equivalent ratio) | 100<br>120<br>0.5 | 167 | 38 | 4.4 | 500 | 1.8 | 0.56 |
| Embodiment 32 | DGEBPA<br>L-MDI<br>2E4MZ-CN<br>(1/E = 2.0 Equivalent ratio) | 100<br>160<br>0.5 | 139 | 36 | 3.9 | 470 | 1.8 | 0.60 |
| Embodiment 33 | DGEBPA<br>L-MDI<br>2E4MZ-CN<br>(1/E = 2.5 Equivalent ratio) | 100<br>120<br>0.5 | 130 | 41 | 3.2 | 370 | 1.6 | 0.36 |
| Embodiment 34 | DGEBPA<br>L-MDI<br>2E4MZ-CN<br>(1/E = 5.0 Equivalent ratio) | 100<br>120<br>0.5 | 130 | 42 | 3.1 | 310 | 1.5 | 0.29 |
| Embodiment 35 | DGEBPA<br>L-MDI<br>2E4MZ-CN<br>(1/E = 0.75 Equivalent ratio) | 100<br>53<br>0.5 | 260 | 30 | 8.7 | 730 | 2.2 | 1.3 |

TABLE 9

| | Resin composition | | Bending strength at 4.2K (MPa) | Cooling restricted thermal stress (MPa) | Stress safety factor | Elastic release energy at 4.2K ($J \cdot m^{-2}$) | Fracture toughness at 4.2K ($MPa \cdot \sqrt{m}$) | Allowable defect size cooled at 4.2K (mm) |
|---|---|---|---|---|---|---|---|---|
| Embodiment 36 | DGEBPA | 100 | 167 | 38 | 4.4 | 500 | 1.8 | 0.56 |
| | MDI | 73 | | | | | | |
| | 2E4MZ-CN | 0.5 | | | | | | |
| | (1/E = 1.0 Equivalent ratio) | | | | | | | |
| Embodiment 37 | DGEBPA | 100 | 139 | 36 | 3.9 | 470 | 1.8 | 0.60 |
| | NDI | 45 | | | | | | |
| | 2E4MZ-CN | 0.5 | | | | | | |
| | (1/E = 0.75 Equivalent ratio) | | | | | | | |
| Embodiment 38 | DGEBPA | 100 | 130 | 41 | 3.2 | 370 | 1.6 | 0.36 |
| | NDI | 60 | | | | | | |
| | 2E4MZ-CN | 0.5 | | | | | | |
| | (1/E = 1.0 Equivalent ratio) | | | | | | | |
| Embodiment 39 | DGEBPA | 100 | 130 | 42 | 3.1 | 310 | 1.5 | 0.29 |
| | PPDI | 35 | | | | | | |
| | 2E4MZ-CN | 0.5 | | | | | | |
| | (1/E = 0.75 Equivalent ratio) | | | | | | | |
| Embodiment 40 | DGEBPA | 100 | 260 | 30 | 8.7 | 730 | 2.2 | 1.3 |
| | PPDI | 46 | | | | | | |
| | 2E4MZ-CN | 0.5 | | | | | | |
| | (1/E = 1.0 Equivalent ratio) | | | | | | | |

TABLE 10

| | Resin composition | | Bending strength at 4.2K (MPa) | Cooling restricted thermal stress (MPa) | Stress safety factor | Elastic release energy at 4.2K ($J \cdot m^{-2}$) | Fracture toughness at 4.2K ($MPa \cdot \sqrt{m}$) | Allowable defect size cooled at 4.2K (mm) |
|---|---|---|---|---|---|---|---|---|
| Embodiment 41 | DGEBPA | 100 | 220 | 33 | 6.7 | 675 | 2.0 | 1.0 |
| | TDI | 37 | | | | | | |
| | 2E4MZ-CN | 0.5 | | | | | | |
| | (1/E = 0.75 Equivalent ratio) | | | | | | | |
| Embodiment 42 | DGEBPA | 100 | 210 | 34 | 6.2 | 600 | 1.9 | 0.84 |
| | TDI | 50 | | | | | | |
| | 2E4MZ-CN | 0.5 | | | | | | |
| | (1/E = 1.0 Equivalent ratio) | | | | | | | |
| Embodiment 43 | DGEBPA | 100 | 280 | 32 | 8.8 | 720 | 2.1 | 1.1 |
| | HMDI | 36 | | | | | | |
| | 2E4MZ-CN | 0.5 | | | | | | |
| | (1/E = 0.75 Equivalent ratio) | | | | | | | |
| Embodiment 44 | DGEBPA | 100 | 260 | 34 | 7.6 | 675 | 2.1 | 0.94 |
| | HMDI | 48 | | | | | | |
| | 2E4MZ-CN | 0.5 | | | | | | |
| | (1/E = 1.0 Equivalent ratio) | | | | | | | |
| Embodiment 45 | DGEBPA | 100 | 290 | 31 | 9.4 | 770 | 2.2 | 1.3 |
| | DPEDI | 54 | | | | | | |
| | 2E4MZ-CN | 0.5 | | | | | | |
| | (1/E = 0.75 Equivalent ratio) | | | | | | | |

TABLE 11

| | Resin composition | | Bending strength at 4.2K (MPa) | Cooling restricted thermal stress (MPa) | Stress safety factor | Elastic release energy at 4.2K ($J \cdot m^{-2}$) | Fracture toughness at 4.2K ($MPa \cdot \sqrt{m}$) | Allowable defect size cooled at 4.2K (mm) |
|---|---|---|---|---|---|---|---|---|
| Embodiment 46 | DGEBPA | 100 | 280 | 31 | 9.0 | 740 | 2.2 | 1.3 |
| | MDI | 40 | | | | | | |
| | NDI | 15 | | | | | | |
| | 2E4MZ-CN | 0.5 | | | | | | |
| | (1/E = 0.75 Equivalent ratio) | | | | | | | |
| Embodiment 47 | DGEBPA | 100 | 208 | 34 | 6.1 | 680 | 2.0 | 0.96 |
| | HMDI | 24 | | | | | | |
| | MDI | 36 | | | | | | |
| | 2E4MZ-CN | 0.5 | | | | | | |
| | (1/E = 1.0 Equivalent ratio) | | | | | | | |
| Embodiment 48 | DGEBPA | 100 | 272 | 31 | 8.8 | 730 | 2.2 | 1.2 |
| | L-MDI | 40 | | | | | | |
| | PPDI | 12 | | | | | | |
| | 2E4MZ-CN | 0.5 | | | | | | |
| | (1/E = 0.75 Equivalent ratio) | | | | | | | |
| Embodiment 49 | DGEBPA | 100 | 272 | 32 | 8.4 | 740 | 2.2 | 01.2 |
| | HMDI | 12 | | | | | | |
| | MDI | 36 | | | | | | |
| | 2E4MZ-CN | 0.5 | | | | | | |
| | (1/E = 0.75 Equivalent ratio) | | | | | | | |

TABLE 12

| | Resin composition | | Bending strength at 4.2K (MPa) | Cooling restricted thermal stress (MPa) | Stress safety factor | Elastic release energy at 4.2K ($J \cdot m^{-2}$) | Fracture toughness at 4.2K ($MPa \cdot \sqrt{m}$) | Allowable defect size cooled at 4.2K (mm) |
|---|---|---|---|---|---|---|---|---|
| Embodiment 50 | DGEBPA | 100 | 28 | 28 | 10 | 750 | 2.2 | 1.6 |
| | L-MDI | 60 | | | | | | |
| | 2E4MZ-CN | 0.5 | | | | | | |
| | (1/E = 0.75 Equivalent ratio) | | | | | | | |
| Embodiment 51 | DGEBPA | 100 | 270 | 32 | 8.4 | 720 | 2.1 | 1.1 |
| | L-MDI | 60 | | | | | | |
| | BDMTDAI | 0.5 | | | | | | |
| | (1/E = 0.75 Equivalent ratio) | | | | | | | |
| Embodiment 52 | DGEBPA | 100 | 275 | 32 | 8.6 | 720 | 2.1 | 1.1 |
| | L-MDI | 60 | | | | | | |
| | BDMTDAI | 0.5 | | | | | | |
| | (1/E = 0.75 Equivalent ratio) | | | | | | | |
| Embodiment 53 | DGEBPA | 100 | 285 | 29 | 9.8 | 760 | 2.3 | 1.5 |
| | L-MDI | 60 | | | | | | |
| | TPP-K | 0.5 | | | | | | |
| | (1/E = 0.75 Equivalent ratio) | | | | | | | |
| Embodiment 54 | DGEBPA | 100 | 300 | 28 | 10.7 | 800 | 2.3 | 1.7 |
| | L-MDI | 60 | | | | | | |
| | BTPP-K | 0.5 | | | | | | |
| | (1/E = 0.75 Equivalent ratio) | | | | | | | |

TABLE 13

| | Resin composition | Bending strength at 4.2K (MPa) | Cooling restricted thermal stress (MPa) | Stress safety factor | Elastic release energy at 4.2K ($J \cdot m^{-2}$) | Fracture toughness at 4.2K ($MPa \cdot \sqrt{m}$) | Allowable defect size cooled at 4.2K (mm) |
|---|---|---|---|---|---|---|---|
| Embodiment 55 | DGEBPA 100<br>L-MDI 60<br>TPP 0.5<br>(1/E = 0.75 Equivalent ratio) | 300 | 28 | 10.7 | 820 | 2.3 | 1.7 |
| Embodiment 56 | DGEBPA 100<br>L-MDI 60<br>LBO 0.5<br>(1/E = 0.75 Equivalent ratio) | 285 | 29 | 9.8 | 800 | 2.3 | 1.5 |
| Embodiment 57 | DGEBPA 100<br>L-MDI 60<br>iPA-Na 0.5<br>(1/E = 0.75 Equivalent ratio) | 280 | 30 | 9.3 | 800 | 2.3 | 1.4 |
| Embodiment 58 | DGEBPA 100<br>L-MDI 60<br>IOZ 0.5<br>(1/E = 0.75 Equivalent ratio) | 285 | 30 | 9.5 | 800 | 2.3 | 1.4 |
| Embodiment 59 | DGEBPA 100<br>L-MDI 60<br>OC 0.5<br>(1/E = 0.75 Equivalent ratio) | 320 | 28 | 11.4 | 820 | 2.3 | 1.7 |

Embodiment 60 and Comparative Example 3

Figure 2:
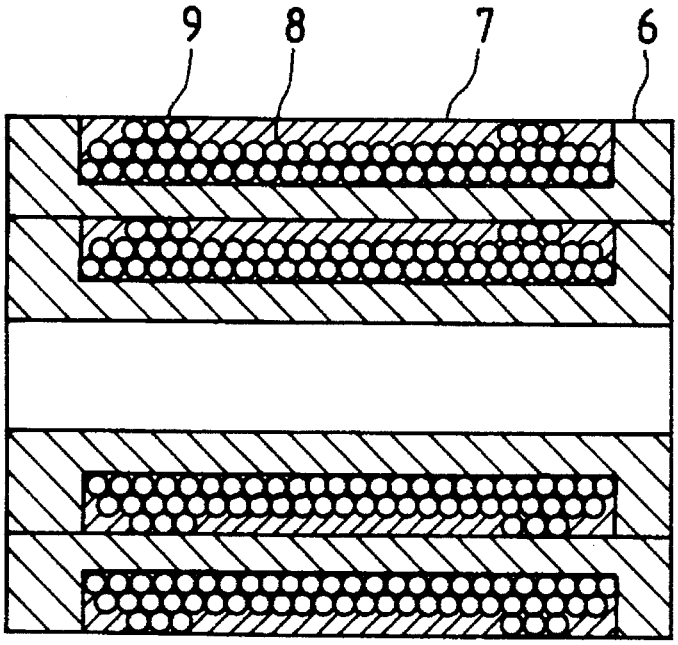
FIG. 2 is a schematic vertical cross section of a permanent current switch relating to the other embodiment of the present invention.

Permanent current switches were manufactured by winding superconducting wires 3, 8 and heating wires 4, 9 coated with polyvinylformal insulator around cylindrical spools 1, 6, and subsequent fixing of the wires with resins 2, 7 which were selected from those used in the embodiments 1–59 and the comparative examples 1, 2 shown in Table 1–13. FIGS. 1 and 2 indicate a schematic vertical cross sections of the permanent current switches. Intervals between the conductors 3, 4 and 8, 9 were adhered sufficiently with the resins 2, 7, and none of voids, cracks, and peeling were observed. After cooling the above described permanent current switch to 4.2 K., vibration was added to the switch. The coils adhered with the resins of the comparative examples caused cracks in the resins 2 used for fixing, subsequently the cracks extended to coated insulating layers of polyvinylformal enamel of the coil conductor 3, and generated peeling of the enamel coated insulating layers. On the other hand, none of resin crack and peeling of the enamel coated insulating layers were observed with the permanent current switches adhered with the resins used in the embodiments 1–59.

Embodiment 61 and Comparative Example 4

Figure 3:
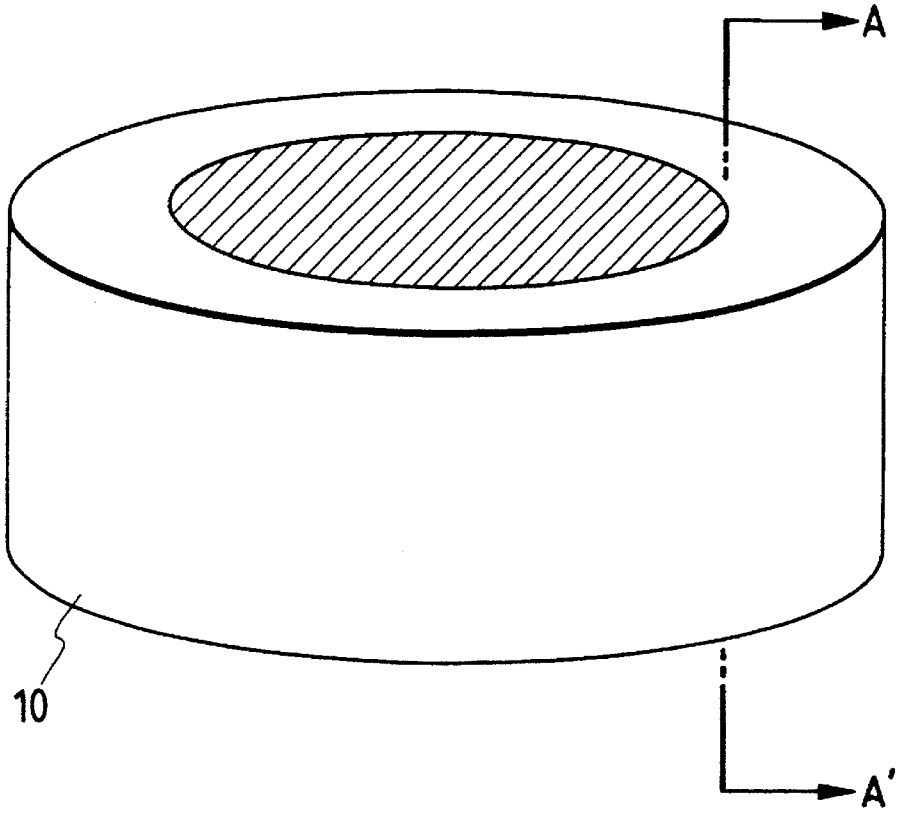
FIG. 3 is a schematic perspective view of a race track type superconducting magnet coil.
Figure 4:
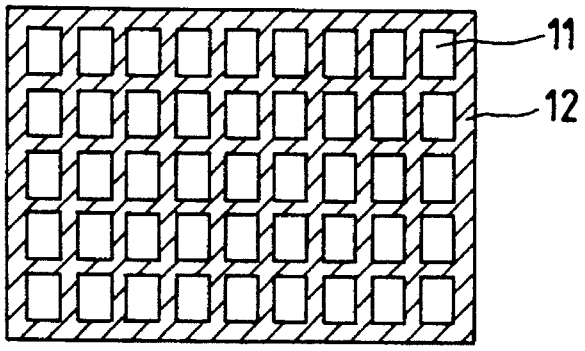
FIG. 4 is a cross section of the coil taken on the line A—A in FIG. 3.

A superconducting magnet coil was manufactured by winding superconducting wire coated with polyvinylformal insulator into a shape of a circle, subsequent fixing of the wire with resin which was selected from those used in the embodiments 1–59 and the comparative examples 1, 2 shown in Table 1–13. FIG. 3 is a schematic perspective view of a superconducting magnet coil, and FIG. 4 is a vertical cross section taken on line A—A of the coil 10 in FIG. 3. All intervals between conductors in the manufactured coils were sufficiently impregnated with fixing resin 12, and none of unimpregnated portion of the resin such as voids was observed. After cooling the above described coil to 4.2 K., vibration was added to the coil. The coils adhered with the resins of the comparative examples 1–2 and embodiments. 32–34 caused cracks in the fixing resin 12, subsequently the cracks extended to coated insulating layers of polyvinylformal enamel 13 of the coil conductor 11, and generated peeling of the enamel coated insulating layers 13. On the other hand, none of resin crack and peeling of the enamel coated insulating layers were observed with the coil adhered with the resins used in the embodiments 1–31 and 35–59.

Embodiment 62 and Comparative Example 5

Figure 5:
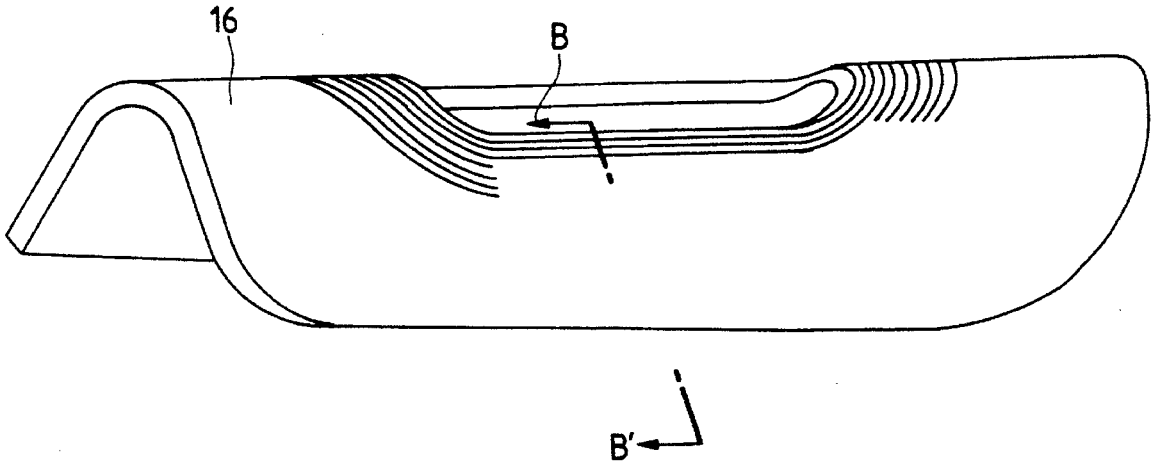
FIG. 5 is a schematic perspective view of a saddle type superconducting magnet coil.
Figure 6:
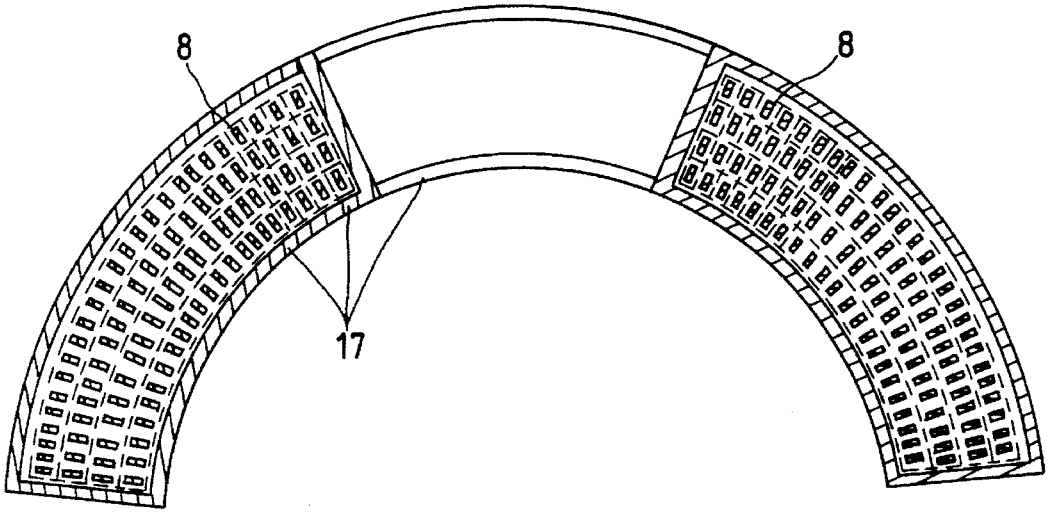
FIG. 6 is a cross section of the coil taken on the line B—B in FIG. 5.

A saddle-shaped superconducting magnet coil 16 was manufactured by winding superconducting wire into a shape of a circle using spacers 17 made from resin which was selected from those used in the embodiments 1–59 and the comparative examples 1, 2 shown in Table 1–13. FIG. 5 is a schematic perspective view of a saddle-shaped superconducting magnet coil, and FIG. 6 is a cross section taken on line B—B' of the coil in FIG. 5. When cooling the above described saddle-shaped coil to 4.2 K., generation of cracks were observed in the resin of the spacer 17 made from resins of the comparative examples 1,2. On the other hand, none of cracks was observed in the resin of the spacer 17 made from the resins used in the embodiments 1–59.

Embodiment 63

Figure 7:
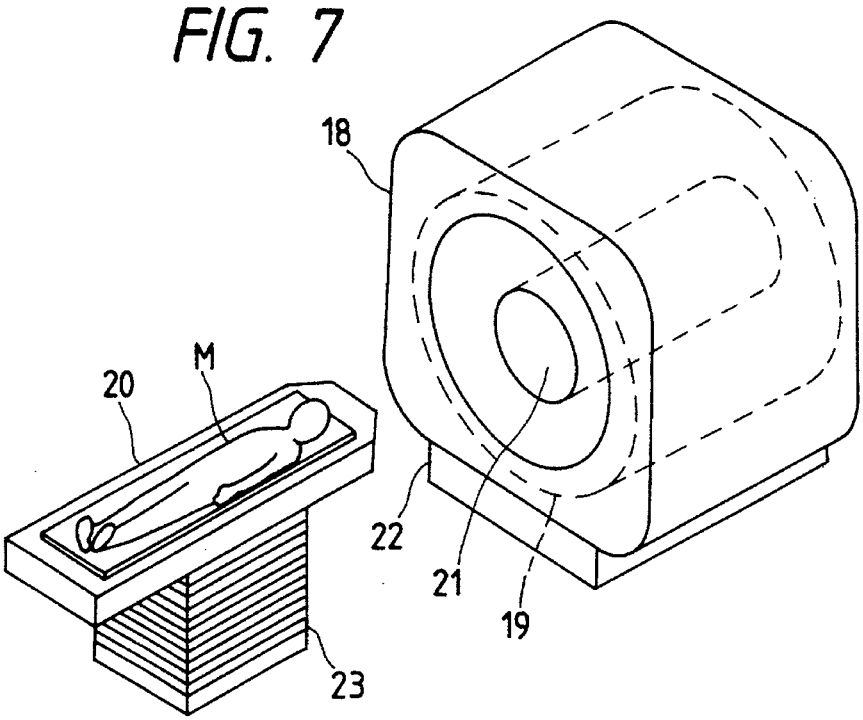
FIG. 7 is a schematic perspective view of a magnetic resonance imaging apparatus.
Figure 8:
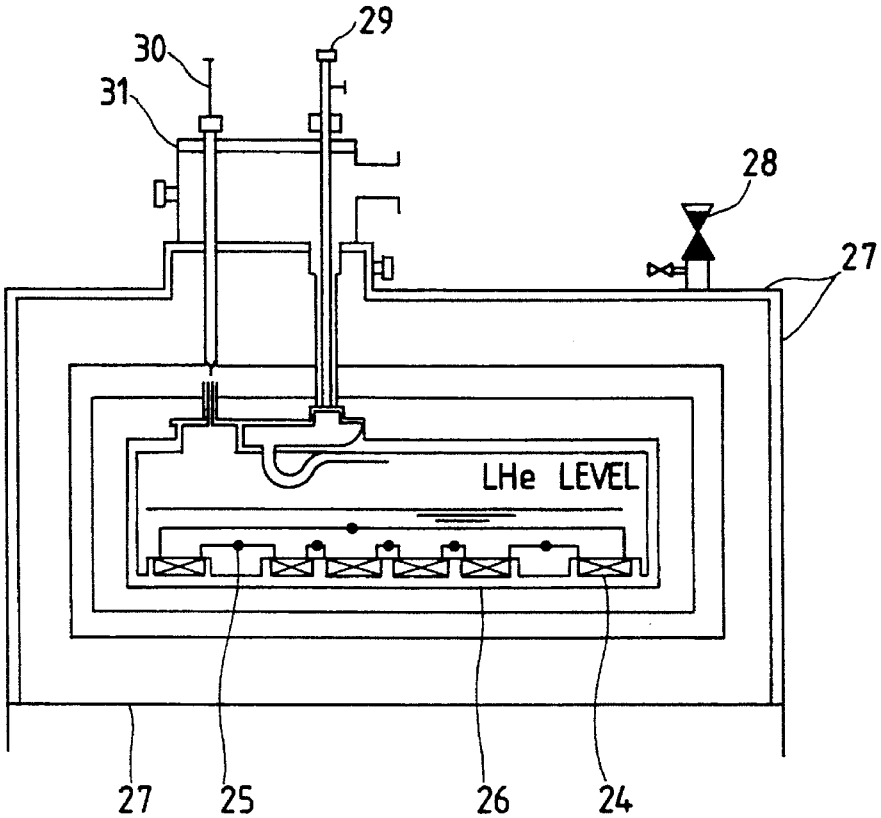
FIG. 8 is a schematic vertical cross section of a cryogenic vessel for the superconducting magnet in FIG. 7.

A superconducting magnet coil was manufactured by winding superconducting wire into a shape of a circle, and subsequent fixing of the wire with resin which was selected from those used in the embodiments 1, 3, 4, 10, 26–29, and the comparative examples 1, 2. A nuclear magnetic resonance tomography apparatus (MRI) was assembled with the above described superconducting magnet coil. FIG. 7 is a schematic perspective view of a nuclear magnetic resonance tomography apparatus showing an outline of an embodiment of the present invention. In FIG. 7, a member designated by a numeral 18 is a device in which an objective man is placed when the tomography by the MRI is performed. A cryogenic vessel 19 for the superconducting magnet is inserted inside the device. The cryogenic vessel 19 for the superconducting magnet has a hollowed cylindrical body as shown by a dot line in FIG. 7, and the hollowed portion forms a through-hole 21 for inserting the man M. A bed 20 which moves with an in-out motion to the through-hole 21 is placed on a skid 23 which stands on floor in front of a flat end of the device 18. A transfer mechanism for the in-out motion of the bed 20 is furnished in the skid 23 although it is not shown in the figure, and the man M placed on the bed 20 is transferred into the through-hole 21 by the in motion of the bed 20 and the nuclear magnetic resonance tomography is performed. FIG. 8 indicates a representative cross section along a central axis of a cryogenic vessel 19 for superconducting magnet. In FIG. 8, a plurality of supermagnet coils 24 are connected each other at connecting portions 25, and form desirable coil turns. The superconducting magnet coils 24 are sealed in a helium tank 26 and cooled to 4.2 K. The helium tank 26 is surrounded with an insulated vacuum vessel 27, and the insulated vacuum vessel 27 is provided with a vacuum pumping connector 28. The helium tank 26 is provided with an inlet 30 for supplying liquid helium, a service port 31 for performing inspection and maintenance of the apparatus, and power lead 29 for connecting to a power source.

While a superconducting magnet coil was cooled to 4.2 K. and a MRI was being operated, cracks were generated in resin of the superconducting magnet coil using resins of the comparative examples 1 and 2, a superconducting condition was broken, a magnetic balance was broken, and a magnetic condition was diminished. On the other hand, the superconducting magnet coil using resins of the embodiments 1, 3, 4, 10, and 26–29, was stable, and normal magnetic condition was maintained continuously.

In accordance with the present invention, the superconducting magnet coil does not generate microcracks in its adhered resin when it is cooled down to a liquid helium temperature, i.e. 4.2 K., after its fabrication, and becomes remarkably stable against quenching, and accordingly, it does not cause quenching even in an operation condition accompanying with a magnetic force.

What is claimed is:

1. A superconducting magnet using a superconducting magnet coil manufactured by winding a superconducting wire and fixing the wire with resin, characterized in that said resin has a stress safety factor, which is defined as (strength/cooling restricted thermal stress), in a range of 3–11 when said resin is cooled from the glass transition temperature of said resin to 4.2 K.

2. A superconducting magnet using a superconducting magnet coil manufactured by winding a superconducting wire and fixing the wire with resin, characterized in that said resin has an equivalent allowable size of defect in a range of 0.3 mm–20 mm when said resin is cooled from the glass transition temperature of said resin to 4.2 K.

3. A superconducting magnet using a superconducting magnet coil manufactured by winding a superconducting wire and fixing the wire with resin, characterized in that said resin has a stress safety factor, which is defined as (strength/cooling restricted thermal stress), in a range of 3–11 and an equivalent allowable size of defect in a range of 0.3 mm–20 mm when said resin is cooled from the glass transition temperature of said resin to 4.2 K.

4. A superconducting magnet using a superconducting magnet coil manufactured by winding a superconducting wire and fixing the wire with resin, characterized in that said resin is an isocyanate-epoxy group resin.

5. A superconducting magnet coil manufactured by winding a superconducting wire and fixing the wire with resin, characterized in that said resin has a stress safety factor, which is defined as (strength/cooling restricted thermal stress), in a range of 3–11 when said resin is cooled from the glass transition temperature of said resin to 4.2 K.

6. A superconducting magnet coil manufactured by winding a superconducting wire and fixing the wire with resin, characterized in that said resin has an equivalent allowable size of defect in a range of 0.3 mm–20 mm when said resin is cooled from the glass transition temperature of said resin to 4.2 K.

7. A superconducting magnet coil manufactured by winding a superconducting wire and fixing the wire with resin, characterized in that said resin has a stress safety factor, which is defined as (strength/cooling restricted thermal stress), in a range of 3–11 and an equivalent allowable size of defect in a range of 0.3 mm–20 mm when said resin is cooled from the glass transition temperature of said resin to 4.2 K.

8. The superconducting magnet coil as claimed in any of claims from 5 to 7, wherein the superconducting wire is covered with at least one member selected from the group consisting of polyvinyl formal, polyvinyl butyral, polyester, polyurethane, polyamide, polyamide-imide, and polyimide.

9. The superconducting magnet coil as claimed in any of claims from 5 to 7, wherein said resin has a release rate of elastic energy at 4.2 K. of 250–10000 $J \cdot m^{-2}$.

10. The superconducting magnet coil as claimed in any of claims from 5 to 7, wherein said resin is a thermoplastic resin having a release rate of elastic energy at 4.2 K. of 250–10000 $J \cdot m^{-2}$.

11. The superconducting magnet coil as claimed in any of claims from 5 to 7, wherein said resin has a stress intensity factor at 4.2 K. of 1.5–8 $MPa \cdot \sqrt{m}$.

12. A permanent current switch using a superconducting magnet coil manufactured by winding a superconducting wire and fixing the wire with resin, characterized in that said resin has a stress safety factor, which is defined as (strength/cooling restricted thermal stress), in a range of 3–11 when said resin is cooled from the glass transition temperature of said resin to 4.2 K.

13. A permanent current switch using a superconducting magnet coil manufactured by winding a superconducting wire and fixing the wire with resin, characterized in that said resin has an equivalent allowable size of defect in a range of 0.3 mm–20 mm when said resin is cooled from the glass transition temperature of said resin to 4.2 K.

14. A permanent current switch using a superconducting magnet coil manufactured by winding a superconducting wire and fixing the wire with resin, characterized in that said resin has a stress safety factor, which is defined as (strength/cooling restricted thermal stress), in a range of 3–11 and an equivalent allowable size of defect in a range of 0.3 mm–20 mm when said resin is cooled from the glass transition temperature of said resin to 4.2 K.

15. A permanent current switch using a superconducting magnet coil manufactured by winding a superconducting wire and fixing the wire with resin, characterized in that said resin is a thermoplastic resin having a release rate of elastic energy at 4.2 K. of 250–10,000 $J \cdot m^{-2}$, said resin being a polyoxazolidone group resin.

16. A magnetic resonance imaging apparatus using a superconducting magnet coil manufactured by winding a superconducting wire and fixing the wire with resin, characterized in that said resin has a stress safety factor, which is defined as (strength/cooling restricted thermal stress), in a range of 3–11 when said resin is cooled from the glass transition temperature of said resin to 4.2 K.

17. A magnetic resonance imaging apparatus using a superconducting magnet coil manufactured by winding a superconducting wire and fixing the wire with resin, characterized in that said resin has an equivalent allowable size of defect in a range of 0.3 mm–20 mm when said resin is cooled from the glass transition temperature of said resin to 4.2 K.

18. A magnetic resonance imaging apparatus using a superconducting magnet coil manufactured by winding a superconducting wire and fixing the wire with resin, characterized in that said resin has a stress safety factor, which is defined as (strength/cooling restricted thermal stress), in a range of 3–11 and an equivalent allowable size of defect in a range of 0.3 mm–20 mm when said resin is cooled from the glass transition temperature of said resin to 4.2 K.

19. A superconducting magnet using a superconducting magnet coil manufactured by winding a superconducting wire in the shape of a coil and fixing the wire with resin, characterized in that said resin consists essentially of a resin composition wherein at least one equivalent of polyfunctional epoxy resin is mixed with 0.1–5 equivalent of polyfunctional isocyanate, and is impregnated into the coil and cured.

20. A superconducting magnet using a superconducting magnet coil manufactured by winding a superconducting wire in the shape of a coil and fixing the wire with resin, characterized in that said resin consists essentially of a resin composition wherein at least one equivalent of polyfunctional epoxy resin is mixed with 0.25–0.9 equivalent of polyfunctional isocyanate, and is impregnated into the coil and cured.

21. A superconducting magnet coil manufactured by winding a superconducting wire in the shape of a coil and fixing the wire with resin, wherein said resin consists essentially of a resin composition wherein at least one equivalent of polyfunctional epoxy resin is mixed with 0.1–5 equivalent of polyfunctional isocyanate, and is impregnated into the coil and cured.

* * * * *